US005379744A

United States Patent [19]

Pischke et al.

[11] Patent Number: 5,379,744

[45] Date of Patent: Jan. 10, 1995

[54] METHOD AND APPARATUS FOR CONTROLLING THE AMOUNT OF EXHAUST GAS RECYCLED IN AN INTERNAL COMBUSTION ENGINE

[75] Inventors: Reiner Pischke, Bad Friedrichshall; Annette Luther, Weinsberg, both of Germany

[73] Assignee: Audi AG, Ingolstadt, Germany

[21] Appl. No.: 156,015

[22] Filed: Nov. 23, 1993

[30] Foreign Application Priority Data

Nov. 26, 1992 [DE] Germany ..... 4239773

[51] Int. Cl.[6] ..... F02M 25/07

[52] U.S. Cl. ..... 123/571

[58] Field of Search ..... 123/571, 568

[56] References Cited

U.S. PATENT DOCUMENTS

| | | | |
|---|---|---|---|
| 4,164,206 | 8/1979 | Toelle | 123/571 |
| 4,212,065 | 7/1980 | Marchak et al. | 123/480 |
| 4,462,376 | 7/1984 | Ripper et al. | 123/571 |
| 4,646,697 | 3/1987 | Grob et al. | 123/425 |
| 4,664,090 | 5/1987 | Kabasin | 123/478 |
| 4,899,282 | 2/1990 | Holmes | 123/425 |
| 5,029,570 | 7/1991 | Stoltman et al. | 123/571 |
| 5,136,517 | 8/1992 | Cullen et al. | 123/478 |
| 5,150,694 | 9/1992 | Currie et al. | 123/569 |
| 5,205,260 | 4/1993 | Takahashi et al. | 123/492 |

FOREIGN PATENT DOCUMENTS

| | | |
|---|---|---|
| 3729468 | 3/1989 | Germany . |
| 3713110 | 1/1991 | Germany . |
| 3428380 | 10/1991 | Germany . |
| 4135190 | 5/1992 | Germany . |
| 4219015 | 12/1992 | Germany . |

*Primary Examiner*—David A. Okonsky

*Attorney, Agent, or Firm*—Kane, Dalsimer, Sullivan, Kurucz, Levy, Eisele & Richard

[57] ABSTRACT

An apparatus for controlling the amount of exhaust gas recycled has a pneumatic valve 7, coupled to a pressure chamber 12 which is connected, on the one hand, over a pipeline 14 with the intake manifold 2 of the internal combustion engine and, on the other, for changing the exhaust gas recycling rate, with the atmosphere over a pipeline 16, through an electromagnetic valve 17. The duty cycle of the cycle valve 17 is varied by electronic control equipment 20 in accordance with the desired rate of recycled exhaust gas. An elevation correction is attained for the recycling rate because the atmospheric pressure is determined from the relationship between the aspirated air mass, determined by an air-mass meter 4 and the throttle valve angle, determined by a sensor 21. The duty cycle of the valve 17 is changed so that the recycling rate for the exhaust gas, which also depends on the load and the rotational speed of the engine remains essentially constant.

6 Claims, 2 Drawing Sheets

METHOD AND APPARATUS FOR CONTROLLING THE AMOUNT OF EXHAUST GAS RECYCLED IN AN INTERNAL COMBUSTION ENGINE

BACKGROUND OF THE INVENTION

A. Field of Invention

This invention pertains to an internal combustion for a motor vehicle with recycled exhaust gas, and more particularly to a method and apparatus for recycling exhaust gas which is automatically adjusted for variations in the atmospheric pressure due to elevational changes.

B. Description of the Prior Art

In conventional internal combustion engines with exhaust gas recycling systems, an exhaust gas recycling valve is provided which is controlled as a function of the rotational speed of the engine and its load. More particularly this valve is closed when the engine is starting, idling or operating at full load, and is partially opened when the engine is under a partial load to control the exhaust gas recycling rate. However if the motor vehicle is operated at higher elevations, the exhaust gas recycling rate is reduced since the intake manifold pressure is unchanged while the exhaust gas counter pressure is reduced with increased elevation resulting a smaller differential pressure at the valve. This reduced exhaust gas recycling rate results in a lower conversion by the catalytic converter and makes it more difficult to recognize misfires. Moreover, normally the exhaust gas recycling system is monitored by a temperature sensor in the exhaust return line and since this sensor indicates a slight increase in temperature at lower exhaust gas recycling rates, the exhaust gas recycling monitoring system becomes unreliable.

In German Patent No. 30 30 128 a sensor for atmospheric pressure is provided to correct the exhaust gas recycling rate for changes in the elevation. This sensor interrupts recycling of the exhaust gas when the atmospheric pressure drops. However this arrangement does not solve the above-mentioned problems but rather amplifies them. In addition this arrangement is expensive since it requires an additional sensor and pipelines for its connection to the gas exhaust recycling system.

In German Patent Offenlegungsschrift No. 37 29 468 an apparatus for recycling exhaust gas is shown with an electromagnetic valve. German patent No. 34 28 380 shows a similar system with a special electronic valve coupled to atmospheric pressure.

OBJECTIVES AND SUMMARY OF THE INVENTION

An objective of the present invention is to provide an internal combustion engine with exhaust gas recycling means in which variations in atmospheric pressure due to changes in elevation are automatically compensated.

A further objective is to provide a system and method in which the exhaust gas recycling is compensated without the necessity of additional components.

A further objective is to provide a system with improved temperature sensing.

Other objectives and advantages of the invention shall become apparent from the following description. Briefly, the subject invention makes use of the fact that as the atmospheric pressure drops at a given position of the throttle valve, the air mass measured by the air mass meter is decreased. Thus, for partial loads, at each throttle angle, the measured mass of air is also indicative of the atmospheric pressure. In the present invention, a graph is prepared and stored relating the throttle angle of the internal combustion engine to the aspired air mass at sea level and various engine loads. In operation, the throttle angle and the aspired air mass at a measured engine load are determined and compared to the same parameters at sea level. If a difference is detected, a correction factor is used to increase the exhaust gas recycling rate. This may be accomplished for example by adjusting the duty cycle of a valve controlling said rate.

Since electronic control equipment is used for generating fuel injection signals, ignition signals and signals for controlling the exhaust gas recycling rate which already receives the rotational speed, the load, the aspirated mass of air and throttle valve angle as input parameters of the internal combustion engine, this equipment is readily modifiable to perform the method described herein without any additional components.

With the subject method, the rotational speed dependent and load-dependent exhaust gas recycling rate can be kept essentially constant independently of the atmospheric pressure. This feature is also of importance with respect to the engine, such as for diagnosis example monitoring of the exhaust gas recycling system. Since the temperature sensor in the exhaust gas return line is now acted upon not, as in the past, by an exhaust gas recycling rate that decreases as the atmospheric pressure decreases, but at a constant exhaust gas recycling rate, this monitoring is more accurate. The reliability of the diagnosis can be improved significantly if, pursuant to a further embodiment of the invention, the temperature sensor is disposed not, as is customary, immediately upstream or downstream of the control valve, but at the point of discharge of the exhaust gas return line into the intake manifold. With this arrangement, the temperature sensor is cooled very rapidly by the intake air after the control valve is closed, so that a leaking valve or a fully opened valve is readily detected.

BRIEF DESCRIPTION OF THE DRAWINGS

An example of the invention is described in the following with reference to the drawings, wherein.

DETAILED DESCRIPTION OF THE INVENTION

Figure 1:
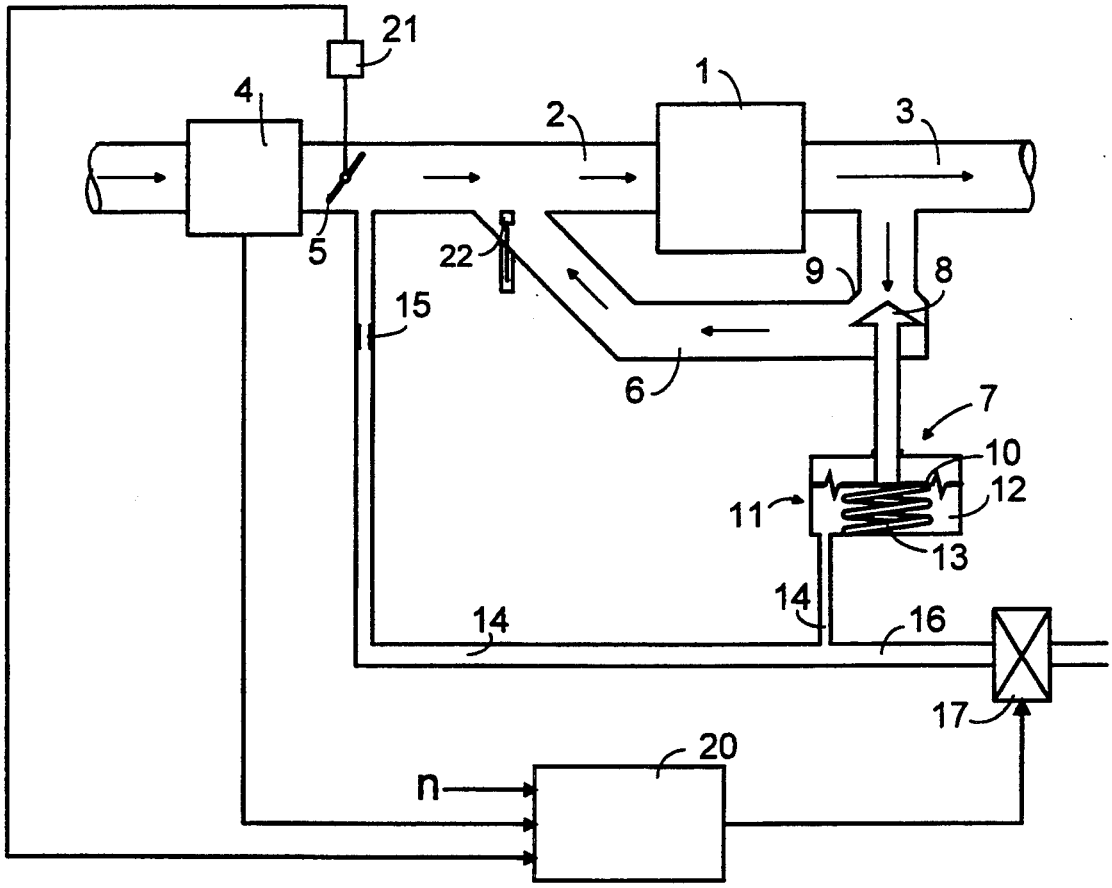
FIG. 1 shows a block diagram of an internal combustion engine with exhaust gas recycling.

Referring now to FIG. 1, an internal combustion engine 1 is shown having an intake manifold 2 and an exhaust manifold 3. An air mass meter 4 and a throttle valve 5 are disposed in the intake manifold. The exhaust manifold 3 is connected to the intake manifold 2 by an exhaust gas return line 6, so that the exhaust gas is discharged into the intake manifold 2 downstream from the throttle valve 5. An exhaust gas return valve (AGR) 7 is disposed in the exhaust gas return line 6. The valve 7 includes a valve body 8 cooperating with a valve seat 9. The valve body 8 is connected with the membrane 10 of a pneumatic servo motor 11 having a chamber 12. The membrane 10 forms the boundary of chamber 12. A return spring 13 is disposed in chamber 12 which acts on the membrane 10 and biases the valve body 8 to its closed position. The chamber 12 is connected by a control pressure pipeline 14 with the intake manifold 2 downstream from the throttle valve 5. Pipeline 14 is provided with a throttle 15. Pipeline 14 is also opened to the atmosphere through an air line 16 and an electromagnetic valve 17. The valve 17 is controlled by an electronic control device 20. More particularly, the valve 17 is cyclically opened and closed in accordance with a duty cycle set by the device 20 to control the position of valve body 8, and therefore the flow rate through pipeline 6 as described below.

Electronic control device 20 received as an input several parameters related to the operation of the internal combustion engine 1. These parameters may include for example the rotational speed of the engine n (received from a tachometer, not shown) the throttle angle DK received from a throttle angle detector 21, and the mass LM of air aspired by engine 1 through intake 2, as measured by mass meter 4. Electronic control device 20 includes a memory containing a performance graph for engine 1 for controlling the operation of valve 17 as a function of n and the load of the internal combustion engine 1. The memory also contains a table relating at sea level, the aspirated air mass LM as measured by meter 4 at various corresponding throttle angles DK.

As mentioned before, the valve body 8 of the valve 7 is held in its closed position by the spring 13, and opens when a reduced pressure develops in the chamber 12 of the pneumatic servo motor 11. This reduced pressure in the chamber 12 corresponds to the reduced pressure in the intake manifold 2 through the control pipeline 14, and is modified by the valve 17. If the fixed cycle valve 17 is fully open, which corresponds to a duty cycle of 0%, the pressure in the chamber 12 is substantially the same as the atmospheric pressure and the valve body 8 is closed by the spring 13. This is the case, for example when the engine is starting, idling, under full load or coasting. When the engine is operated in a partial load range, the duty cycle of valve 17 is controlled by the electronic control device 20 as a function of n and the load in such a way that body 8 is partially open to attain a desired exhaust gas recycling rate.

Figure 2:
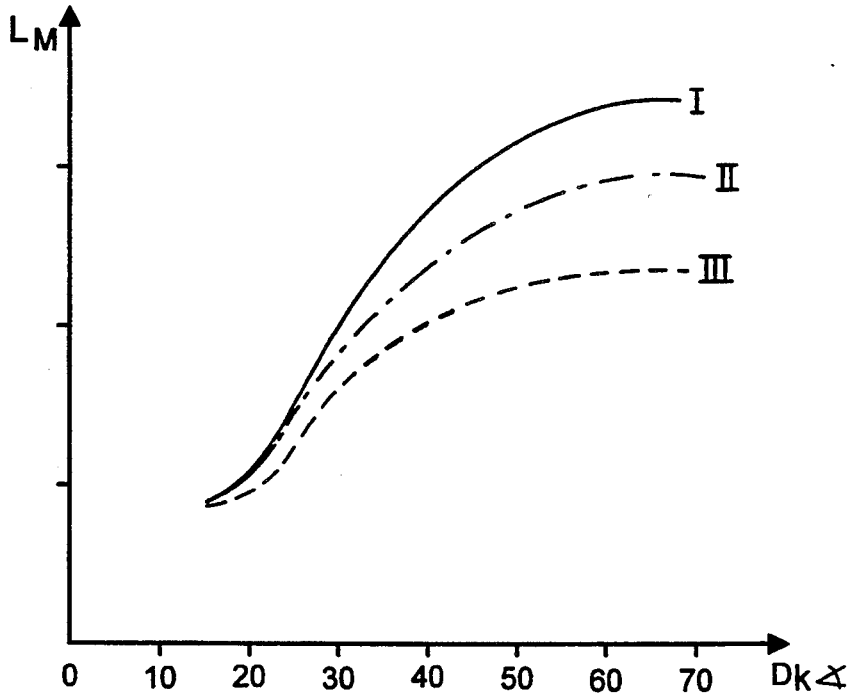
FIG. 2 shows a graph illustrating the aspirated mass of air as a function of the throttle valve angle at different atmospheric pressure.

As previously mentioned, the throttle valve angle DK and the aspirated air mass LM measured by the air mass meter 4 are supplied as input parameters to the electronic control device 20. FIG. 2 shows the effect of atmospheric pressure on the aspirated air mass LM at a given throttle valve angle. In the graph of FIG. 2, the solid line 1 represents the measured, aspirated air mass LM at sea level and a temperature of 40° C. as a function of the throttle valve angle. The dot-dash line II represents the air mass LM at an elevation of 1,600 m and a temperature of 20° C. and the broken line III represents the air mass LM at an elevation of 3,300 m and a temperature of 10° C. It is evident that, particularly at throttle valve angles between 40° and 60°, the normal range in to which exhaust gas is recycled, the aspirated air mass falls significantly with increasing elevation. While the intake manifold vacuum is substantially constant at all elevations for a particular throttle valve angle, the exhaust gas counter-pressure, that is, the pressure in the exhaust manifold 3 drops from about 1 bar at sea level to about 0.7 bar at 3,300 m. As a consequence, the pressure difference across the valve 7 falls with increasing elevation, which has the undesirable consequences mentioned above initially including a reduced exhaust gas recycling rate.

In order to compensate for this elevational change in the exhaust gas recycling rate, the atmospheric pressure is used to determine a correction factor in accordance with this invention by the electronic control device 20 as follows. The aspirated air mass LM measured by the air mass meter 4, is constantly compared with the aspirated air mass at sea level for each throttle valve angle DK and stored in the memory of device 20. A correction factor for the duty cycle of the electromagnetic valve 17 is generated from the difference between the actual aspirated air mass and the corresponding air mass at sea level for the same throttle angle. More specifically, the duty cycle is adjusted by multiplying it with the correction factor, in order to open the value 17 more than at sea level to achieve an essentially constant exhaust gas recycling rate independent of elevation.

Figure 3:
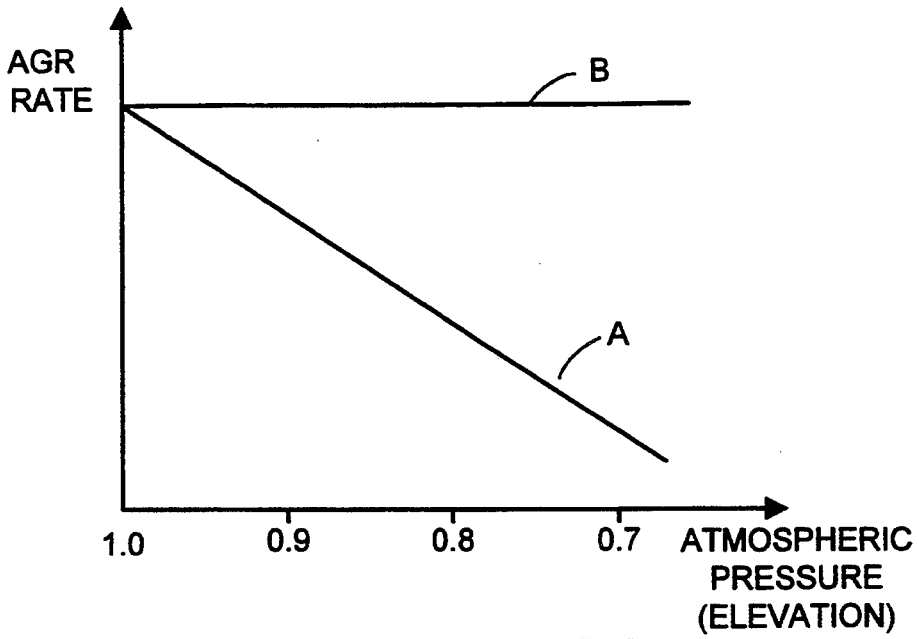
FIG. 3 shows a graph for the exhaust gas recycling rate as a function of the atmospheric pressure for a particular performance graph.

FIG. 3 shows the effect of the inventive elevation correction on the exhaust gas recycling rate for a particular performance operating point, that is, for a particular rotational speed n and a particular load. In this graph, line A illustrates the decline in the exhaust gas recycling rate with decreasing atmospheric pressure, when the duty cycle of the valve 17 remains constant, while the line B represents the same rate when the duty cycle is corrected as disclosed above. It is evident that the exhaust gas recycling rate remains essentially constant independent of the atmospheric pressure and elevation.

Figure 4:
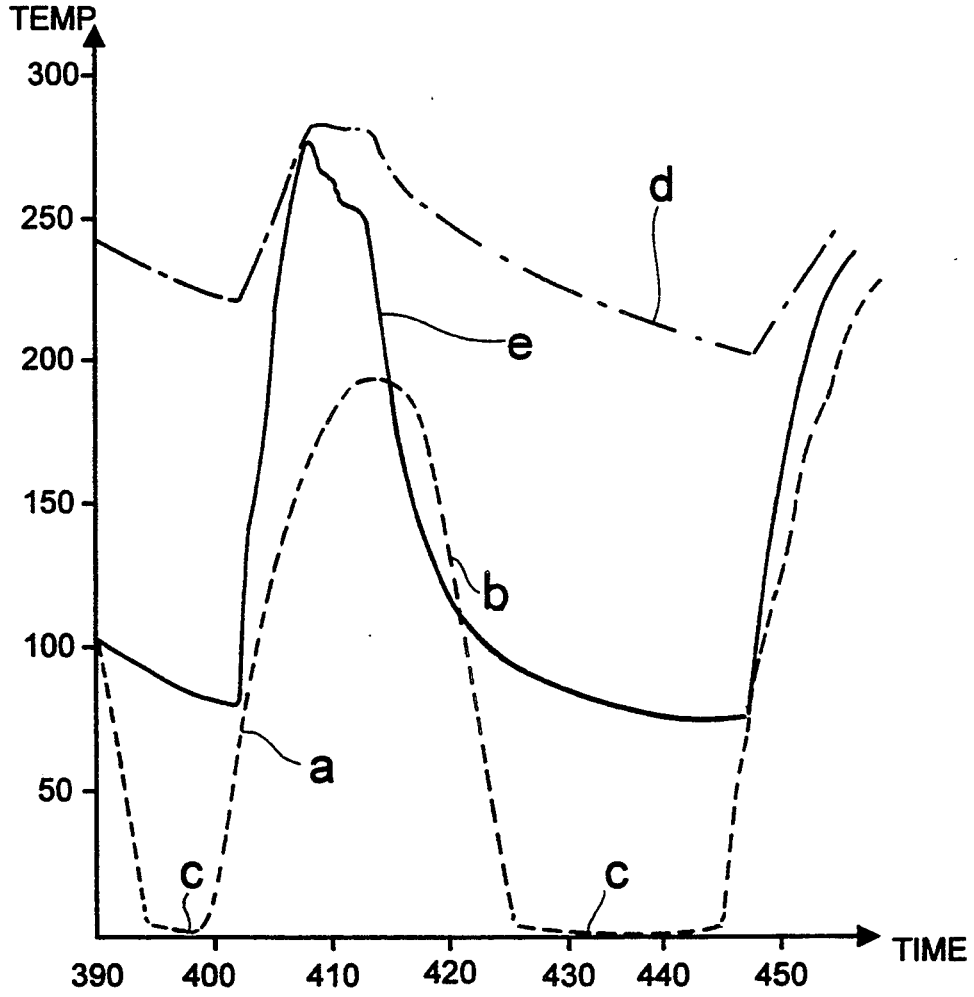
FIG. 4 show a graph indicating the temperature changes in the exhaust gas return line over a particular operating range.

The constant exhaust gas recycling rate, as mentioned above also improves the reliability of the monitoring or diagnosis of the exhaust gas recycling system, since erroneous readings caused by low gas recycling rates are eliminated. For this purpose, it is particularly advantageous to dispose a temperature sensor 22 for the diagnosis of the exhaust gas recycling system as close as possible to the mouth where the exhaust gas return line 6 discharges into the intake manifold 2 as shown. This arrangement is advantageous in that it allows the device 20 to recognize very quickly whether the exhaust gas recycling system in working properly or not. After the valve 7 is closed, the temperature sensor is cooled down very quickly by the aspirated air. However, if the valve 7 is not quite closed, the sensor 22 senses a temperature, which cannot occur when the valve is either fully closed or open. In this case warning light may be switched on by device 20 to indicate a malfunction in the exhaust gas recycling system. Compared to the usual arrangement of the temperature sensor in the exhaust gas return line either upstream or immediately downstream of the valve 7, a much faster identification of abnormally high or low recycled exhaust gas amounts is provided, as a result of the improved disposition of the temperature sensor, because the sensor's output extends over a more pronounced temperature range. This is evident from the graph of FIG. 4. In this graph, the broken line a shows the rotational speed of the engine for a certain duration. This line a includes segment b showing the engine accelerating and engine decelerating, and segments c showing the engine idling. The dot-dash line d illustrates the temperature variation corresponding to the engine speed when the temperature sensor is disposed in the exhaust gas return line upstream of the valve 7 and the solid line e illustrates the temperature variation sensed when the sensor 21 is disposed where the exhaust gas return line 5 discharges into the intake manifold 2. As can be seen, the temperature increase in the acceleration phase and the temperature decrease in the deceleration phase at a slope which is significantly steeper for line e. As a result, the temperature of the recycled exhaust gas can be determined significantly more precisely than previously.

Obviously numerous modifications may be made to this invention without departing from its scope as defined in the appended claims.

We claim:

1. An internal combustion engine assembly comprising:

an internal combustion engine having an intake manifold for aspiring air and an exhaust manifold exhausting a gas resulting from combustion therein;

exhaust gas recycling means for recycling said gas, said exhaust gas recycling means including a pipe extending from said exhaust manifold to said intake manifold, and exhaust valve means for controlling the rate of flow of said gas through said pipe;

aspired air mass metering means for metering a mass of said aspired air though said intake manifold to generate an aspired air mass signal;

a throttle disposed in said intake manifold and means for measuring a throttle angle of said throttle;

an electronic control receiving said aspired air mass signal and the throttle angle measurement, said control being provided to compare said aspired air mass signal and the throttle angle measurement to a preselected value to determine if said engine is operating at a certain elevation;

a memory means for holding said preselected value determined by measuring said aspired air mass signal and the throttle angle measurement at a preselected elevation;

said exhaust valve means includes a valve body extending into said pipe and cooperating with a valve seat and a diaphragm controlling the position of said valve body;

said exhaust valve means further includes a chamber connected to said intake manifold and housing said diaphragm and a spring for biasing said valve body to a preselected position;

an electric valve connecting said chamber to atmosphere; and said electric valve has a duty cycle controlled by said electronic control.

2. The assembly of claim 1 wherein the control operates to adjust said exhaust valve means to increase the exhaust gas flow rate at the certain elevation.

3. The assembly of claim 1 wherein said preselected elevation is sea level.

4. The assembly of claim 1 further comprising a temperature sensor for sensing a temperature of said exhaust gas.

5. The assembly of claim 4 wherein said sensor is disposed in said pipe.

6. The assembly of claim 5 wherein said pipe has a mouth connected to said intake manifold, said sensor being disposed adjacent to said mouth.

* * * * *